US005522187A

United States Patent [19]

Bogaerts

[11] Patent Number: 5,522,187

[45] Date of Patent: Jun. 4, 1996

[54] SLOPING ROOF WITH ROOFING TILES AND TILE HOOK FOR SUCH A ROOF

[75] Inventor: Albert F. J. Bogaerts, Ravenstein, Netherlands

[73] Assignee: Bove Draadprodukten B.V., Ravenstein, Netherlands

[21] Appl. No.: 307,607

[22] PCT Filed: Mar. 26, 1993

[86] PCT No.: PCT/NL93/00074

§ 371 Date: Sep. 21, 1994

§ 102(e) Date: Sep. 21, 1994

[87] PCT Pub. No.: WO93/20304

PCT Pub. Date: Oct. 14, 1993

[30] Foreign Application Priority Data

Apr. 3, 1992 [NL] Netherlands ..... 9200632
Aug. 3, 1992 [NL] Netherlands ..... 9201397

[51] Int. Cl.[6] ..... E04B 7/06; E04D 3/36; E04D 1/34

[52] U.S. Cl. ..... 52/90.1; 52/520; 52/546; 52/547; 52/548; 52/549; 52/489.1; 52/489.2; 52/358; 52/359; 52/362; 52/712; 52/714

[58] Field of Search ..... 52/549, 548, 547, 52/546, 520, 489.1, 489.2, 712, 714, 702, 358, 359, 362, 90.1

[56] References Cited

U.S. PATENT DOCUMENTS 1,517,944 12/1994 Bobbitt .
2,106,948 2/1938 Harrington ..... 52/547
4,141,191 2/1979 Aarons .

FOREIGN PATENT DOCUMENTS 353322 9/1905 France .
132214 7/1901 Germany .
395607 7/1921 Germany .
1998239 12/1968 Germany .
3509077 9/1986 Germany .
195007 5/1938 Switzerland .
2101172 1/1983 United Kingdom .

*Primary Examiner*—Carl D. Friedman
*Assistant Examiner*—Christopher Todd Kent
*Attorney, Agent, or Firm*—Young & Thompson

[57] ABSTRACT

The roof tiles (1) of a sloping roof rest via a ridge on tile laths (2) and overlap one another in two directions. They are fixed with tile hooks (4) and each tile hook (4) comprises a first shaft section (7), which at the free end has a hook-shaped bend (8) which grips around a closing groove (6) on a side edge of a first tile, a second shaft section (9), which at the free end has a device (10) by which the tile hook is fixed to a tile lath (2), and a shoulder (11), which is located between the two shaft sections (7 and 9) and engages on the rear surface of a second tile partially located under the first tile. The two shaft sections (7 and 9) of the tile hooks are essentially perpendicular to the shoulder (11).

12 Claims, 5 Drawing Sheets

SLOPING ROOF WITH ROOFING TILES AND TILE HOOK FOR SUCH A ROOF

FIELD OF THE INVENTION

The invention primarily relates to a sloping roof provided with roofing tiles, the roofing tiles resting by means of a ridge on tile laths, overlapping one another in two directions and being fixed by means of tile hooks, and each tile hook comprising a first shaft section which at the free end has a hooked shaped bend which grips around a closing groove on a side edge of a first tile, a second shaft section having means by which the tile hook is fixed to a tile lath and a shoulder which is located between the two shaft sections, both shaft sections extending essentially perpendicular to the said shoulder of hooks.

BACKGROUND OF THE INVENTION

A roof of this type is disclosed in FR-A-353322.

The most important function of tile hooks is to prevent the tiles rattling and falling from the roof when the wind force is high. The bond between the tiles which can be produced by means of the known tile hooks leaves something to be desired; the so-called pull-out value is low, that is to say that in the event of strong wind suction there is a risk of the tiles rattling and coming loose.

The aim of the invention is to avoid this disadvantage and to provide a sloping roof, indicated in the preamble, the tile hooks of which roof have a very high pull-out value (for example about 250N per hook) and can be fixed extremely simply with one hand.

SUMMARY OF THE INVENTION

According to the invention, the sloping roof is, to this end, characterized in that the shoulder of the hooks engages on the rear surface of a tile partially located under an other tile, that the length of the shoulder, viewed in a direction perpendicular to the shaft sections, is essentially equal to the distance between the upper surface of a tile lath and the top edge of said other tile, that the first shaft section merges into the plane of the shoulder by a sharp 90°-fold and is straight along its entire length having no twisted portion, and that the distance between a shoulder and a hook shaped bend of a tile hook is essentially equal to the thickness of two tiles at the location of their overlap, such that the two tiles are clamped and pressed onto one another between a shoulder and a bend of a tile hook.

The invention also relates to a tile hook which is to be used for a slooping roof and comprises a first shaft section, which at the free end has a hook-shaped bend, a second shaft section which at the free end has means for fixing the tile hook to a tile lath, and a shoulder which is located between said shaft section, the two shaft sections extending essentially perpendicular to said shoulder.

According to the invention the plane of the first shaft section merges into the plane of the shoulder by a sharp 90°-fold and is straight along its entire length having no twisted portion.

The tile hook can be improved if the tile hooks are able to bend in a controlled manner when the tiles are lifted as a result of a strong suction effect and, when the suction effect has passed, the hooks, despite their bending, are capable of fulfilling the same clamping function. To this end the fixing means for fixing the tile hook to a tile lath comprise a number of pins which extend perpendicularly to a strip which is connected by means of an attenuation to the second shaft section, at least one reinforcing rib or ridge extending in the longitudinal direction of the second shaft section, the shoulder and the bend between them.

In general, the most significant advantage of the tile hook according to the invention is that the bottom edge of a tile located above said hook and the top edge of a tile located below said hook are clamped to one another between the hook-shaped bend and the shoulder, it being possible, when the tile hook is used, to regard the tiles of a sloping roof as a single roofing body. The capacity to withstand walking on is greatly improved. When fitting, the tile hook can be positioned in the correct position and fixed with one hand, and when the hook is in the fitted position a firm bond is established between two tiles located above one another.

The tile hook according to the invention can be used on all tiles, both concrete and ceramic.

The said attenuation between the second shaft section and the strip pins can be formed by punching two triangular sections from that end of the second shaft section which faces strip and bending said triangular sections through 90°.

For some applications it can be preferable for the first shaft section to have, at its free end, two hook-shaped bends which diverge.

According to the invention, the tile hook can be made from a metal strip. In this case a double fold is made between the first shaft section and the shoulder, such that the surface of the strip section which forms the first shaft section is perpendicular to the surface of the strip section which forms the shoulder. This ability to produce the tile hook from a single long strip has significant advantages from the production standpoint. Moreover, the double fold results in a rigid connection between the shoulder and the first shaft section.

If the tile hook is made of wire, the shoulder can be formed by a wire loop. The loop can be of a width such that it is able to engage on the rear surface of two adjacent tiles. A broad "shoulder" of this type which is able to engage on the rear surface of two adjacently positioned tiles beneath it can, of course, also form part of a plastic tile hook obtained by injection moulding.

The means for fixing a tile hook produced from wire to a tile lath can comprise a counter-hook which is able to engage on the rear surface of the tile lath.

It is pointed out that GB-A 1 174 891 discloses a tile hook comprising a first shaft section, which at the free end has a hook-shaped bend, a second shaft section, which at the free end has means for fixing the tile hook to a tile lath, and a transition piece between said shift sections. However, the second shaft section does not extend perpendicularly to said transition piece and engages on a side of the tile lath instead of on the top of the tile lath. Because of their special shape, the tiles can be placed only straight above one another. As the transition piece does not have a broadened section, it does not act as a shoulder. Moreover, the transition piece is difficult to place beneath a tile. In addition, with this known tile hook it is not possible to achieve the exceptionally high pull-out value of the tile hook according to the invention.

BRIEF DESCRIPTION OF THE DRAWINGS

The invention will now be explained in more detail with the aid of the figures.

DETAILED DESCRIPTION OF THE INVENTION

Figure 1:
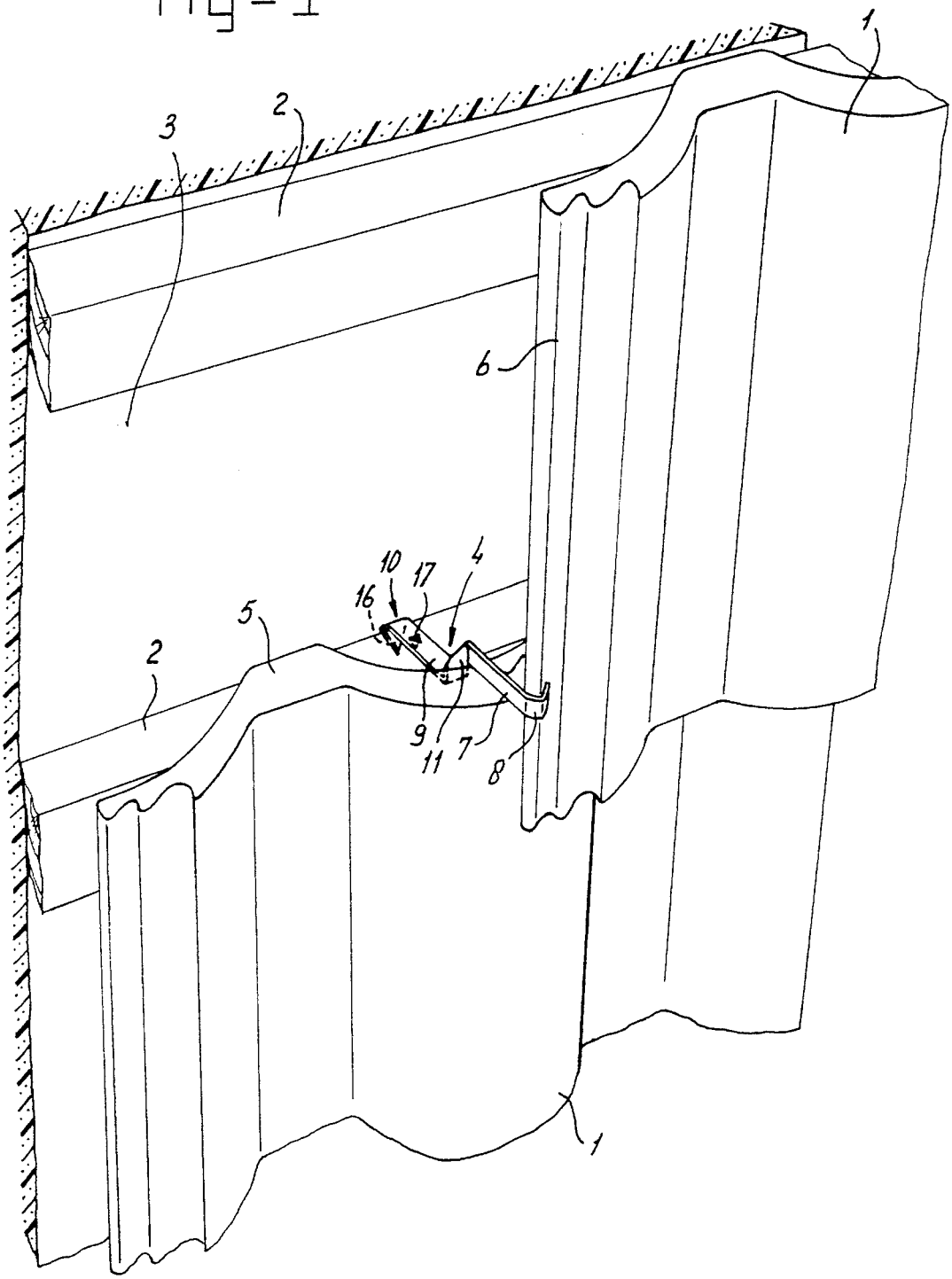
FIG. 1 shows a perspective view of a section of a sloping roof covered with tiles, an embodiment of the tile hook according to the invention being used for fixing the tiles.
Figure 2:
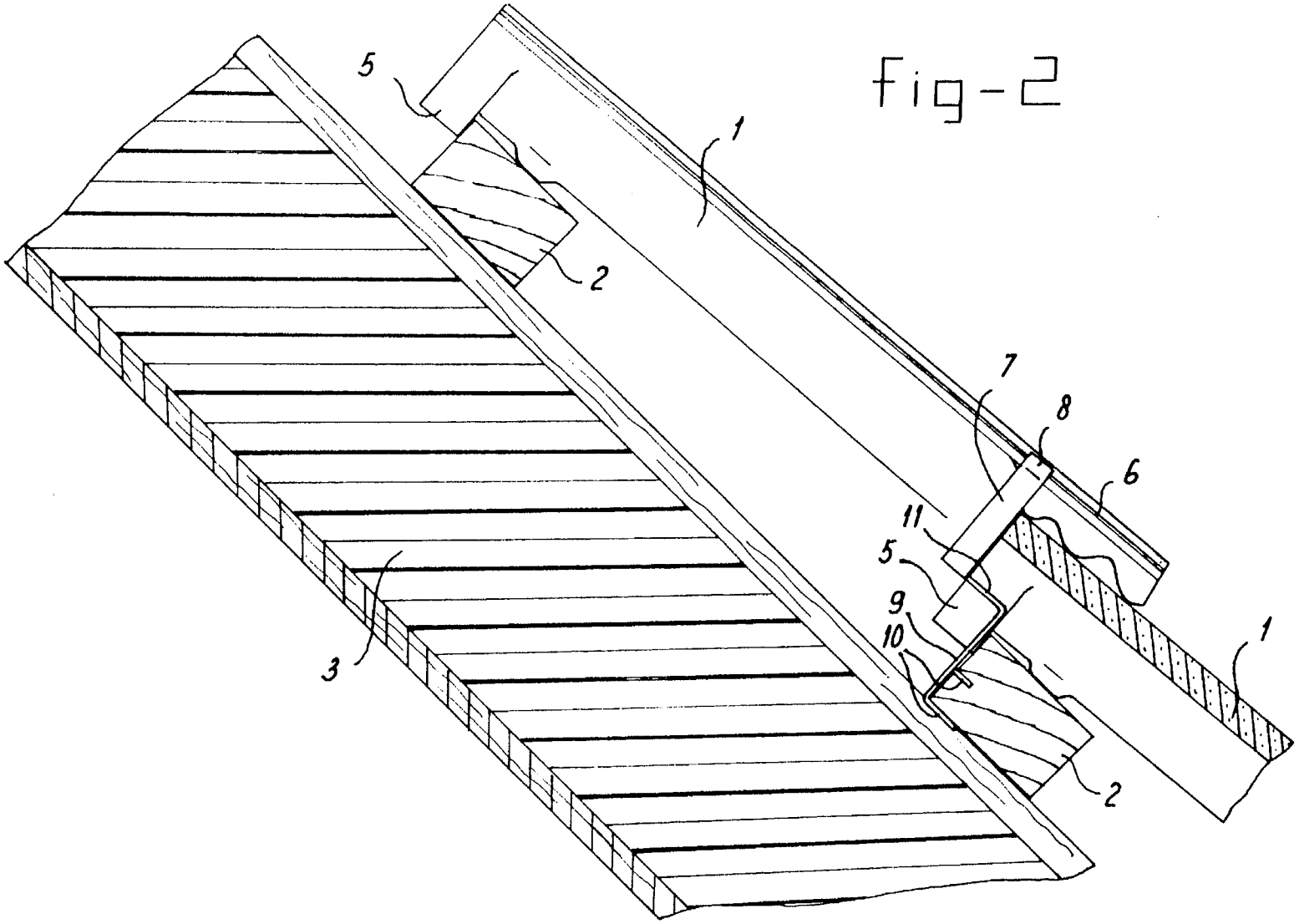
FIG. 2 shows a cross-section of the sloping roof according to FIG. 1.

In the figures, the tiles are designated 1, the tile laths 2, the roof boarding 3 and a tile hook 4. Each tile has, at the upper edge, a ridge 5, by means of which it rests on a tile lath, and, at the left outer side, a closing groove 6, on which the right inner side of an adjacent overlapping tile engages. The bottom edge of a tile projects over the top edge of a tile placed below it.

The tile hook has a first shaft section 7, which at the free end has a hook-shaped bend to embrace the closing groove 6 of a tile, a second shaft section 9, which at the free end has means 10 for fixing the tile hook to a tile lath 2, and a shoulder 11, which is located between the two shaft sections 7 and 9 and extends perpendicularly to the longitudinal direction of the shaft sections 7 and 9. Both shaft sections 7 and 9 extend essentially perpendicular to the shoulder 11. The length of the shoulder 11, viewed in a direction perpendicular to the shaft sections 7 and 9, is essentially equal to the height of a tile ridge 5. This height is also equal to the distance between the top surface of a tile lath 2 and the upper edge of a second tile located beneath it. This means that the second shaft section 9 lies on the top surface of the tile lath 2 and the distance between the shoulder 11 and the hook-shaped bend 8 of the first shaft section 7 is equal to the thickness of two tiles at the site of their overlap. The two tiles can thus be clamped between the shoulder 11 and the bend 8 and pressed together without an intervening body.

The bottom surface of the upper tile and the top surface of the lower tile are clamped together before the fixing means 10 are struck into a tile lath 2. A significant advantage is that the tile hook is positioned and fixed by exertion of said clamping force before the fixing means 10 are struck into a tile lath 2, as a result of which fitting and fixing of the tile hook can easily be carried out with one hand.

After the fixing means 10 of the tile hooks have been struck home in a tile lath 2, tilt-free connection of the tiles to the tile laths is achieved as a consequence of the clamping of the tiles positioned above one another. In fact, the tiles together form a single robust roofing body.

Figure 3:
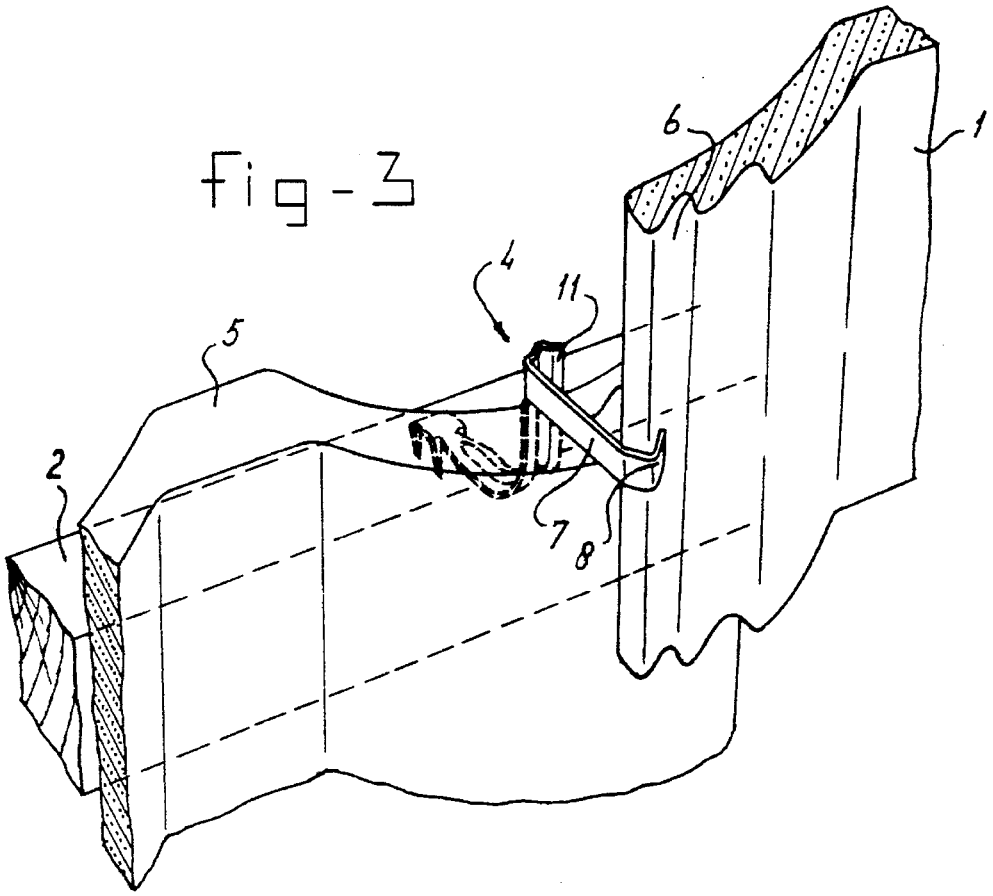
FIG. 3 shows a perspective view of a section of a sloping roof covered with tiles, the preferred embodiment of the tile hook according to the invention being used for fixing the tiles.
Figure 4:
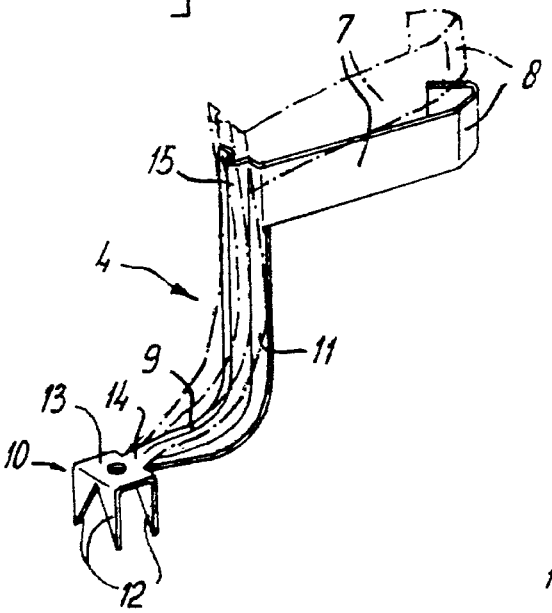
FIG. 4 shows a perspective view of the tile hook according to FIG. 1 and the dot-and-dash line indicates how the tile hook may look after bending.

In the case of the embodiment according to FIGS. 3, 4 and 5, the fixing means 10 comprise four pins 12, which are arranged in a square and extend perpendicularly to a strip 13, which is connected via an attenuated section 14 to the end of the second shaft section 9. The pins 12 at the side of the end of the second shaft section 9 are formed by punching triangular sections from said shaft section end, the width of the strip material from which the tile hook is formed being reduced at that point and the material attenuation 14 thus being produced. Other material attenuations are also possible. The pins 12 can be milled or deformed in some other way to achieve improved grip.

A reinforcing ridge 15 extends in the longitudinal direction of the second shaft section 9 and the shoulder 11, and also over the bend-shaped connection between these. The first shaft section 7 is not reinforced by a rib or ridge.

After the pins 12 of the fixing means have been struck home in the upper surface of a tile lath 2, a tilt-free connection of the tiles to the tile laths is achieved as a consequence of the clamping of the tiles positioned above one another. In fact, the tiles together form a single robust roofing body.

If a pull is exerted on the roofing body, for example as a result of the suction effect in the case of a severe storm, the roofing body composed of tiles will be lifted, it being possible for a number of tile hooks to be bent at the location of the connection 14 between the strip 13 and the second shaft section 9 and the connection between the first shaft section 7 and the shoulder 11. The dot-and-dash line in FIG. 4 shows what a tile hook bent in this way looks like.

After the suction effect has ceased and the tiles are back in their original position, it is found that the bent tile hooks exert essentially the same clamping effect on overlapping tiles. Because shaft section 9 has been able to follow the bending with respect to strip 13, the quality of the connection between the pins 12 and the wood of the tile laths is unchanged or hardly changed. Sections 9 and 11 are adequately reinforced to counteract deformation.

Figure 5A:
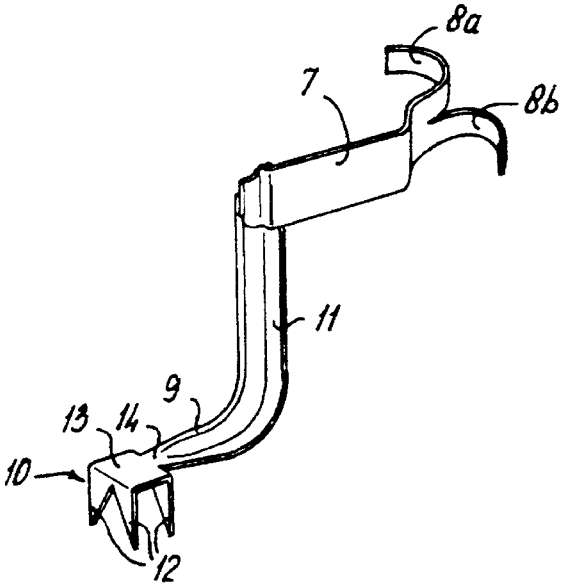
FIG. 5*a* shows an alternative embodiment of the tile hook according to FIGS. 3 and 4.
Figure 5B:
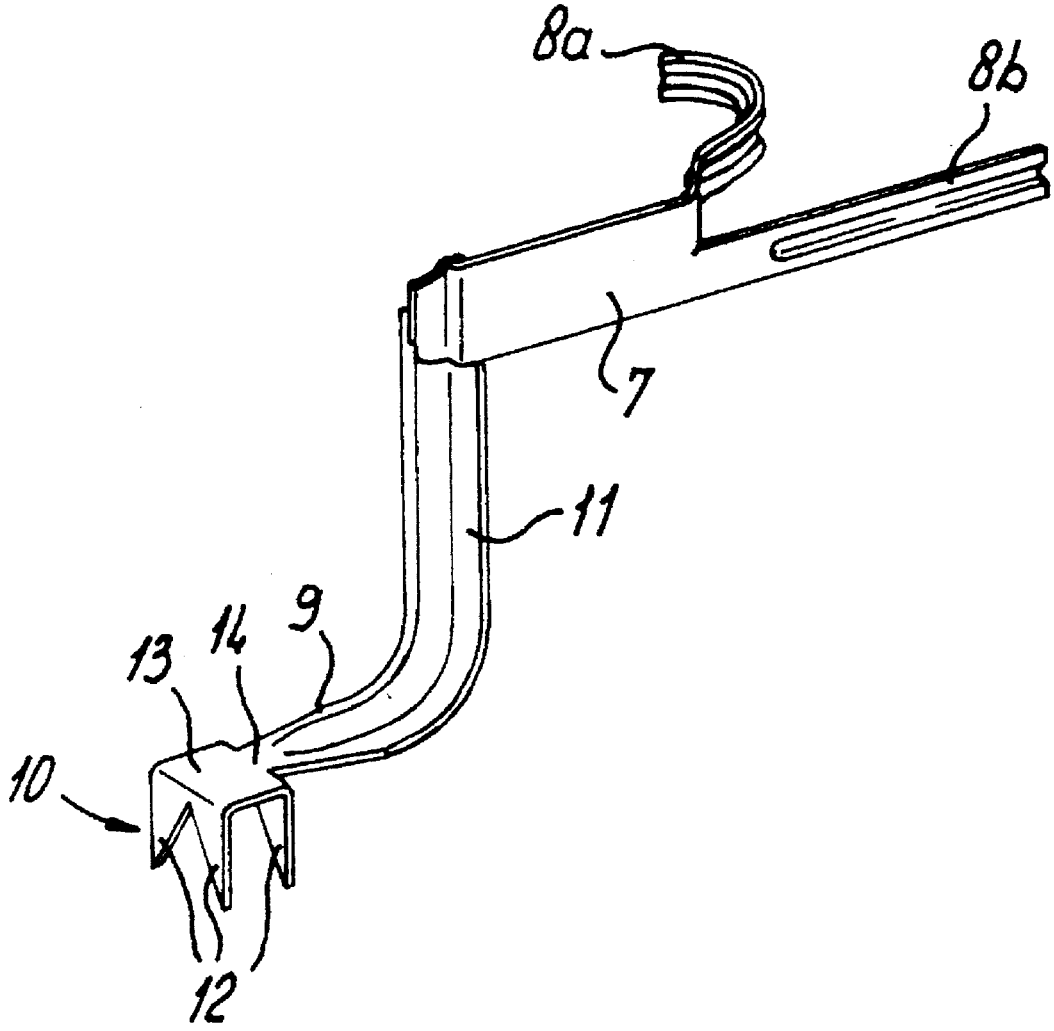
FIG. 5*b* shows an embodiment which is modified somewhat compared with FIG. 5*a*.

The embodiment according to FIG. 5*a* has two hook-shaped bends 8*a* and 8*b*, each intended to embrace a closing groove of a tile. FIG. 5*b* differs from FIG. 5*a* in that section 8*b* is straight and can be bent through a cavity later.

Figure 6:
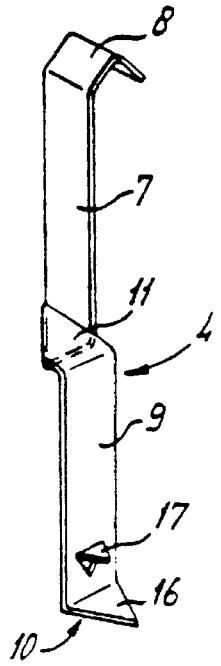
FIGS. 6 to 10 show various alternative embodiments of a tile hook according to the invention.
Figure 7:
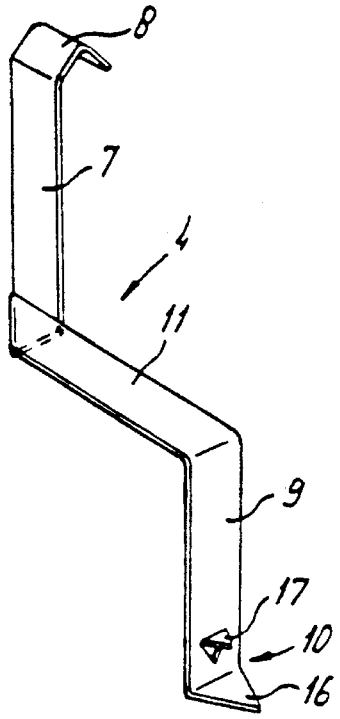

In the embodiments according to FIGS. 6 and 7, the shoulder 11 is formed from a strip by folding said strip twice at the underside of shaft section 7: once about an oblique fold line and once about a transverse fold line. The rigidity of the connection between shaft section 7 and shoulder 11 is increased as a result. Because the hook is produced from strip, the production method is extremely efficient.

Figure 8:
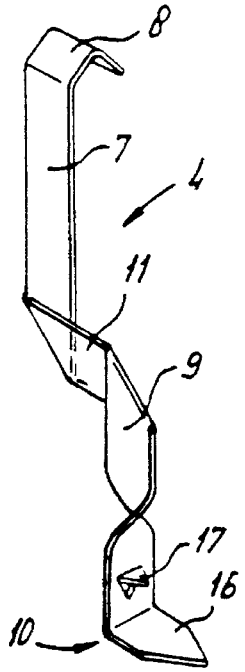

FIG. 8 shows a variant in which the shoulder 11 is located at the side edge of a strip section delimited between two oblique fold lines.

Figure 9:
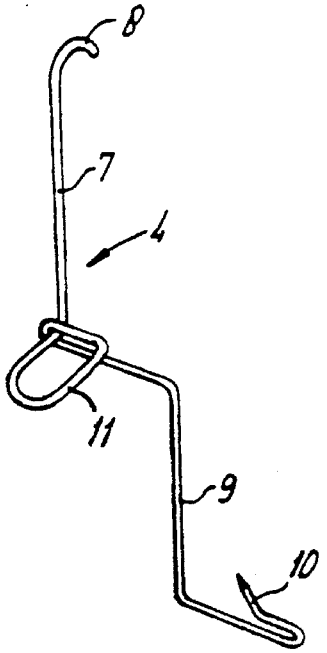
Figure 10:
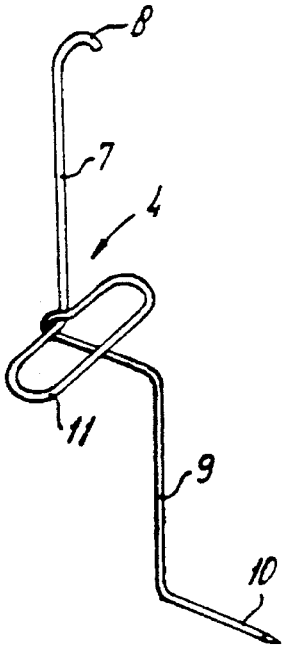

FIGS. 9 and 10 show tile hook embodiments made from metal wire. The shoulder 11 is formed by shaping a wire loop. In the embodiment according to FIG. 10 the wire loop is sufficiently wide for it to be able, when the tile hook is mounted, to engage on the rear surface of the top edge of two adjacent tiles, as a result of which a rigid clamp connection can be achieved between an upper tile and two lower tiles using a single tile hook; tilting of tiles by a suspension ridge is prevented and it becomes possible to walk on the roof.

The fixing means 10 in the embodiment according to FIG. 9 comprise a counter-hook to be hooked into the rear of a tile lath. In the embodiment according to FIG. 10, the fixing means 10 are of simple design in the form of a bent wire section provided with a point.

Of course, according to the principle of the invention a tile hook can also be made from a robust plastic.

Depending on the shape and the position of the second tile, the shoulder can be made on the right with respect to the first shaft section. The flattest side of the second tile preferably serves as support for the shoulder.

What is claimed is:

1. In a sloping roof comprising a plurality of roofing tiles, each roofing tile having a ridge, and a side edge including a closing groove, said roofing tiles resting by their ridges on tile laths, said roofing tiles overlapping one another in two directions, and being fixed by tile hooks, each tile hook comprising a first shaft section having at one free end a hook-shaped bend, a second shaft section having at one free end means for fixing the tile hook to a tile lath, and a shoulder located between said first and second shaft sections, said first and second shaft sections extending essentially perpendicular to said shoulder, the improvement wherein:

the shoulder engages on the rear surface of a first tile partially located under a second tile, the length of the shoulder, viewed in a direction perpendicular to the shaft sections, is essentially equal to the distance between the upper surface of a tile lath and the top edge of said second tile, the first shaft section merges into the plane of the should by a sharp 90° fold and is straight along its entire length having no twisted portion, and the distance between the shoulder and the hook-shaped bend of a tile hook is essentially equal to the thickness of two tiles at the location of their overlap, such that the two tiles are clamped and pressed onto one another between the shoulder and the bend of the tile hook.

2. A tile hook for securing overlapping roofing tiles to a sloping roof, comprising: a first shaft section having at one free end a hook-shaped bend, a second shaft section having at one free end means for fixing the tile hook to a tile lath, and a shoulder located between said first and second shaft sections, said first and second shaft sections extending essentially perpendicular to said shoulder, wherein the plane of the first shaft section merges into the plane of the shoulder by a sharp 90° fold, and is straight along its entire length having no twisted portion and the distance between the shoulder and the hook-shaped bend of the tile hook is adapted to be essentially equal to the thickness of two tiles at the location of their overlap, such that the two tiles are clamped and pressed onto one another between the shoulder and the bend of the tile hook.

3. The tile hook according to claim 2, wherein the fixing means for fixing the tile hook to a tile lath comprise a number of pins which extend perpendicularly to a strip which is connected via an attenuation to the second shaft section, and at least one reinforcing rib extends in the longitudinal direction of the second shaft section, the shoulder, and the bend between them.

4. The tile hook according to claim 3, wherein the attenuation between the second shaft section and the strip with pins is formed by punching two triangular sections from that end of the second shaft section which faces said strip, and bending said triangular sections through 90°.

5. The tile hook according to claim 3, wherein the first shaft section has, at its free end, two hook-shaped bends which diverge.

6. The tile hook according to claim 2, wherein the means for fixing the tile hook to a tile lath comprise a hook-shaped bend adapted to embrace a tile lath, and at least one punched-out, approximately triangular point, intended to be inserted into the tile lath.

7. The tile hook according to claim 2, wherein said hook is made from a metal strip.

8. The tile hook according to claim 7, further comprising a double fold made between the first shaft section and the shoulder, such that the surface of the strip section which forms the first shaft section is perpendicular to the surface of the strip section which forms the shoulder.

9. The tile hook according to claim 2, wherein said hook is made from wire.

10. The tile hook according to claim 9, wherein said shoulder is formed by a wire loop.

11. The tile hook according to claim 10, wherein the loop has a width sufficiently wide to enable the tile hook when mounted, to engage on the rear surface of two adjacent tiles.

12. The tile hook according to claim 9, wherein the means for fixing the tile hook to a tile lath comprise a counter-hook for engaging on the rear surface of the tile lath.

* * * * *